US006755160B2

(12) United States Patent
Zimmermann

(10) Patent No.: US 6,755,160 B2
(45) Date of Patent: Jun. 29, 2004

(54) INTERNAL COMBUSTION ENGINE FOR A HANDHELD PORTABLE WORK APPARATUS

(75) Inventor: Helmut Zimmermann, Hösslinswart (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/108,888

(22) Filed: Mar. 29, 2002

(65) Prior Publication Data

US 2002/0139325 A1 Oct. 3, 2002

(30) Foreign Application Priority Data

Mar. 29, 2001 (DE) ..... 101 15 484
Sep. 5, 2001 (DE) ..... 101 43 435

(51) Int. Cl.[7] ..... F02B 75/02
(52) U.S. Cl. ..... 123/65 A
(58) Field of Search ..... 123/73 C, 184.46, 123/73 A, 184.23, 65 A, 184.39, 184.61

(56) References Cited

U.S. PATENT DOCUMENTS 1,810,917 A * 6/1931 Kreis ..... 123/430
2,201,014 A * 5/1940 Scheerer Georg ..... 123/559.1
4,669,434 A 6/1987 Okumura et al.
4,711,225 A * 12/1987 Holderle et al. ..... 123/590
4,852,526 A * 8/1989 Brown ..... 123/184.42
5,065,708 A * 11/1991 Wehle et al. ..... 123/73 C
5,474,039 A 12/1995 Döragrip

* cited by examiner

*Primary Examiner*—Tony M. Argenbright
*Assistant Examiner*—Hyder Ali
(74) *Attorney, Agent, or Firm*—Walter Ottesen

(57) ABSTRACT

The invention relates to an internal combustion engine for a portable handheld work apparatus including a motor-driven chain saw, cutoff machine or the like and relates especially to a two-stroke engine having an inlet opening (3) provided in the cylinder (2) of the engine (1) for an air/fuel mixture (4). An intake stub (5) is made of elastic material and functions to guide the air/fuel mixture (4) from a carburetor into the inlet opening (3). To ensure a uniform operation of the engine, a fuel collecting device (6) is provided for fuel (7) precipitated in the intake stub (5). The fuel collecting device (6) is delimited at least partially by the intake stub (5) and is connected to the cylinder (2) by a channel (8) opening at the inlet opening (3).

16 Claims, 6 Drawing Sheets

INTERNAL COMBUSTION ENGINE FOR A HANDHELD PORTABLE WORK APPARATUS

FIELD OF THE INVENTION

The invention relates to an internal combustion engine for a handheld portable work apparatus such as a motor-driven chain saw, brushcutter, cutoff machine or the like. The invention is especially directed to a two-stroke engine.

BACKGROUND OF THE INVENTION

In known internal combustion engines, and to provide a vibration-decoupled connection of the carburetor to an inlet opening for the air/fuel mixture, the carburetor is connected to the inlet opening with the aid of an intake stub of elastic material. The inlet opening is provided in the cylinder of the engine.

During the operation of the engine, the air/fuel mixture flows from the carburetor to the inlet opening and is deposited, in part, on the wall in the interior of the intake stub. The fuel, which is deposited in the intake stub, forms bubbles or collections of fuel depending upon the position of the work apparatus. The bubbles or collections of fuel are stochastically drawn by suction into the inlet opening when pivoting the work apparatus and can lead to an overenrichment of the air/fuel mixture. Especially at idle of the engine, this can lead to ignition misfires or even to standstill of the engine.

SUMMARY OF THE INVENTION

It is an object of the invention to improve a known internal combustion engine in such a manner that a uniform operation is possible.

The internal combustion engine of the invention includes a two-stroke engine for a portable handheld work apparatus including a motor-driven chain saw and cutoff machine. The engine includes: a cylinder having an inlet opening for receiving an air/fuel mixture; an intake stub through which the air/fuel mixture passes and wherein fuel can precipitate out of the air/fuel mixture during operation of the engine; the intake stub being made of elastic material and being mounted to conduct the air/fuel mixture into the inlet opening; a fuel collecting device for collecting the fuel precipitated in the intake stub; the fuel collecting device being delimited at least partially by the intake stub; and, a channel connecting the fuel collecting device to the cylinder.

The engine is provided with a fuel collecting device (especially at the intake stub) for uniformly conducting away fuel which deposits in the interior of the intake stub during operation of the engine. The fuel collecting device is mounted between the inlet opening and the carburetor viewed in the axial direction of the intake stub and is delimited at least partially by the intake stub. A channel is guided between an opening at the inlet opening at the cylinder and the fuel collecting device. The channel connects the fuel collecting device to the cylinder, that is, the crankcase. The channel conducts fluids from the fuel collecting device to the cylinder.

The inlet opening and the opening of the channel at the cylinder are controlled by the piston reciprocating in the cylinder during operation of the engine configured as a two-stroke engine. For this reason, cyclical underpressures are present at the inlet opening as well as in the channel itself. The underpressure is therefore present also in the channel and the fuel collecting device and effects a drawing in of the fuel, which collects in the fuel collecting device, into the cylinder or into the crankcase of the engine. In this way, during operation of the engine, a uniform conducting away of fuel is effected which deposits on the inner side of the wall of the intake stub. A uniform operation of the engine is thereby made possible.

The fuel collecting device can be configured in different ways, such as a collection space in the form of a recess in the intake stub. It can be practical to arrange the fuel collecting device in the proximity of the inlet opening and it is practical to configure the fuel collecting device as a collecting enclosure especially with respect to the technical manufacture of the intake stub. The collecting enclosure is delimited by a cylindrical outer surface at the inlet opening and a surface of the intake stub. It is practical to configure the collecting enclosure as an annular enclosure between the cylinder outer surface around the inlet opening and the intake stub to conduct away the deposited fuel from the total peripheral region in the interior of the intake stub.

A bellows-like thickening is provided on the intake stub in order to compensate longitudinal changes of the intake stub during operation of the engine. The thickening can expand the clear cross section of the intake stub in the region of the thickening. It is practical to provide the thickening interior space as a collecting device or collecting enclosure for fuel. To conduct away fuel deposited on the inner side of the intake stub, it can be practical to configure the fuel collecting stub in the form of openings which open in the interior of the intake stub and which are connected fluidly to the channel. The openings can be arranged as desired in the longitudinal direction or in the peripheral direction of the intake stub. It can be practical to allow the openings to open at spacings to each other sieve-like at one or several locations in the intake stub or partially in the intake stub and partially at the inlet opening at the cylinder.

In a preferred embodiment, the channel runs from the cylinder or crankcase interior in the intake stub of the cylinder below the inlet opening. The channel opens below the inlet opening into the cylinder or into the crankcase of the engine. In this way, the channel is emptied of collected fuel during operation of the engine because of the crankcase underpressure and then the inlet opening is cleared for the air/fuel mixture. In this way, fuel is conducted out of the fuel collecting device with each induction stroke. In dependence upon the spatial arrangement of the fuel collecting device and especially its arrangement in the axial direction of the intake stub, the channel opens directly at the cylinder outer surface into the fuel collecting device configured as a collecting enclosure or annular enclosure. If the fuel collecting device is in the form of a collecting device mounted axially from the cylinder outer surface at a spacing and is configured in the intake stub (as collection enclosure, thickening inner enclosure or openings preferably arranged sieve-like), then it is practical to lead the channel along the outer side of the intake stub to the collecting device. It can be practical to lead the channel in the wall of the intake stub or in the interior of the intake stub itself essentially in axial direction of the intake stub and to configure the channel as one piece with the intake stub from parts of the wall of the intake stub.

The channel as well as the intake stub itself is preferably cylindrically shaped. The channel has a significantly smaller inner diameter than the inner diameter of the intake stub. Preferably, the inner diameter of the channel is approximately ten times smaller than the inner diameter, especially the mean inner diameter, of the intake stub. With this constructive measure, a high flow velocity is provided in the channel and a reliable permanent removal of the fuel, which collects in the fuel collecting device, via the channel is ensured.

If, as a fuel collecting device, the thickening interior enclosure of the thickening at the intake stub is provided, then, in dependence upon the flow conditions during operation of the engine in the interior of the intake stub, it can be practical to arrange the thickening axially centered or in the proximity of the carburetor and/or cylinder end flange of the intake stub.

For effective supply of the deposited fuel into the thickening interior enclosure, which is charged with cyclical underpressure from the channel, it is practical to configure the clear width or the inner diameter of the intake stub (with reference to the flow direction of the air/fuel mixture in the intake stub) upstream of the thickening to be equal to or greater than downstream of the thickening. In addition, it is practical to lead the wall in the form of a ring-shaped section axially over the thickening on the inner side of the intake stub. In this way, an axially displaceable covering of the thickening interior enclosure results in the region of the thickening. Here, it is the object to extend the ring-shaped axial section beyond the length of the thickening and to provide this section as a lip in the intake channel. In this way, the expansion fold which the thickening forms is sealed off under specific operating conditions and yet an expansion and contraction of the expansion fold is not hindered.

The covering clears an annular gap to the interior space of the thickening with a corresponding axial displacement. In this way, fuel, which is precipitated onto the wall of the intake stub (especially in the region of the annular-shaped section), flows in the radial direction of the intake stub into the interior space of the thickening and, from there, the fuel is conducted away by the channel. This pumping away of the fuel takes place with the frequency of the engine and is not determined stochastically by the work technique of the operator. It can be practical to provide cutouts on the lip or annular-shaped edge of the annular-shaped section to facilitate the inflow of the precipitated fuel. With the cutouts, precipitated fuel can be conveyed continuously into the interior space of the thickening.

It can be practical to subdivide the channel to the fuel collecting device or to the interior space of the thickening into several branch channels. With this measure, fuel can be conducted away over the entire periphery of the thickening. With this measure, fuel is conducted away independently of the particular work position of the portable handheld work apparatus. In lieu of branching the channel into branch channels, it can be practical to lead several channels from the corresponding fuel collecting device into the cylinder.

In a preferred embodiment, a check valve is mounted in the channel which prevents fuel from being conveyed from the cylinder into the channel by an overpressure in the crankcase or in the cylinder. The check valve can be configured from a rubber membrane.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
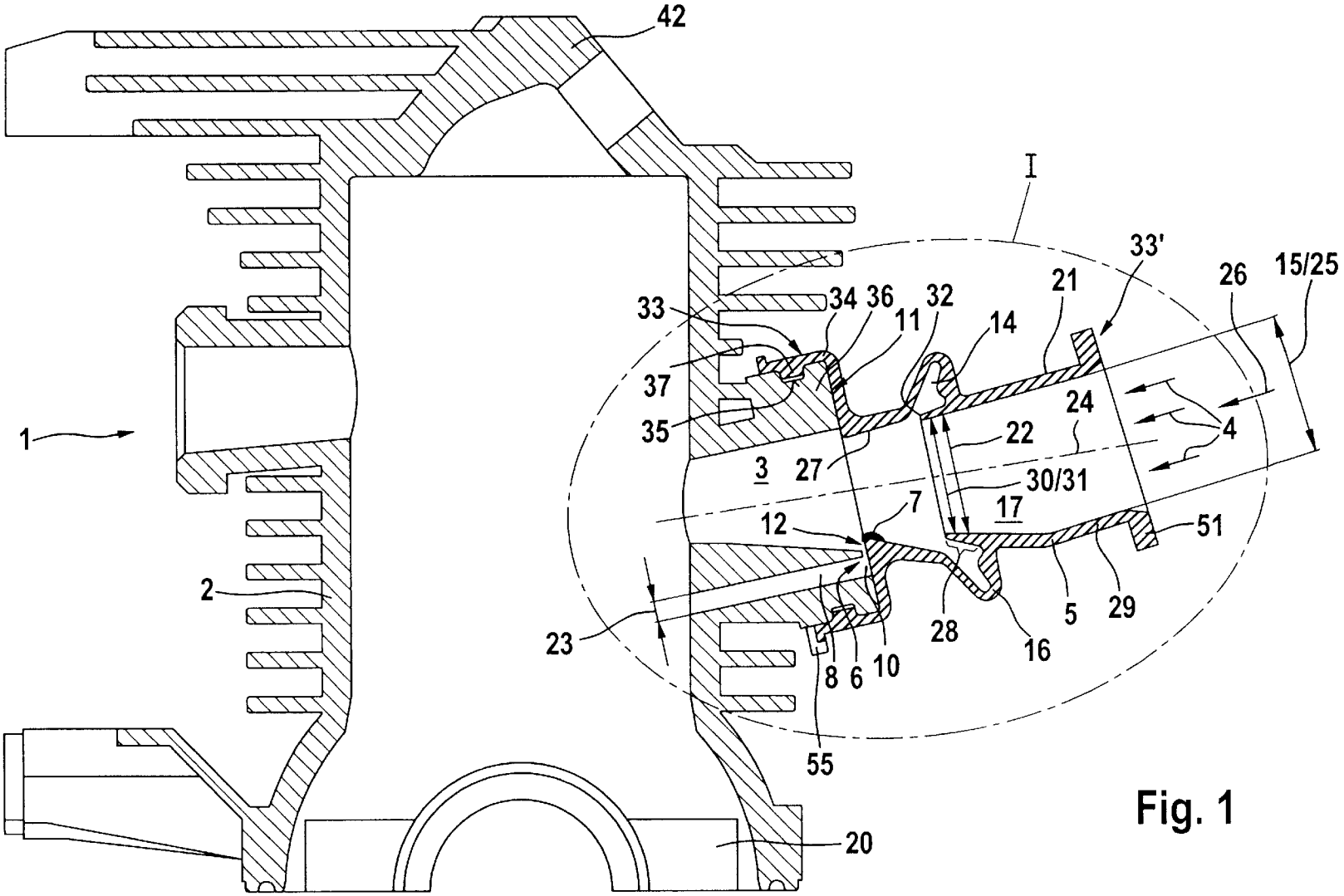
FIG. 1 is a longitudinal section view taken through the cylinder of an internal combustion engine.

FIG. 1 is a partial view, in longitudinal section, of an internal combustion engine 1 configured as a two-stroke engine. An intake stub 5 for conducting the air/fuel mixture 4 into an inlet opening 3 on the cylinder 2 of the engine 1 is formed as one piece and is made of rubber-elastic material. This material is resistant to high temperatures and can, for example, be a vulcanizable fluoroelastomer on the basis of vinylidene fluoride hexafluoro propylene copolymerization and analog terpolymerization.

Figure 1A:
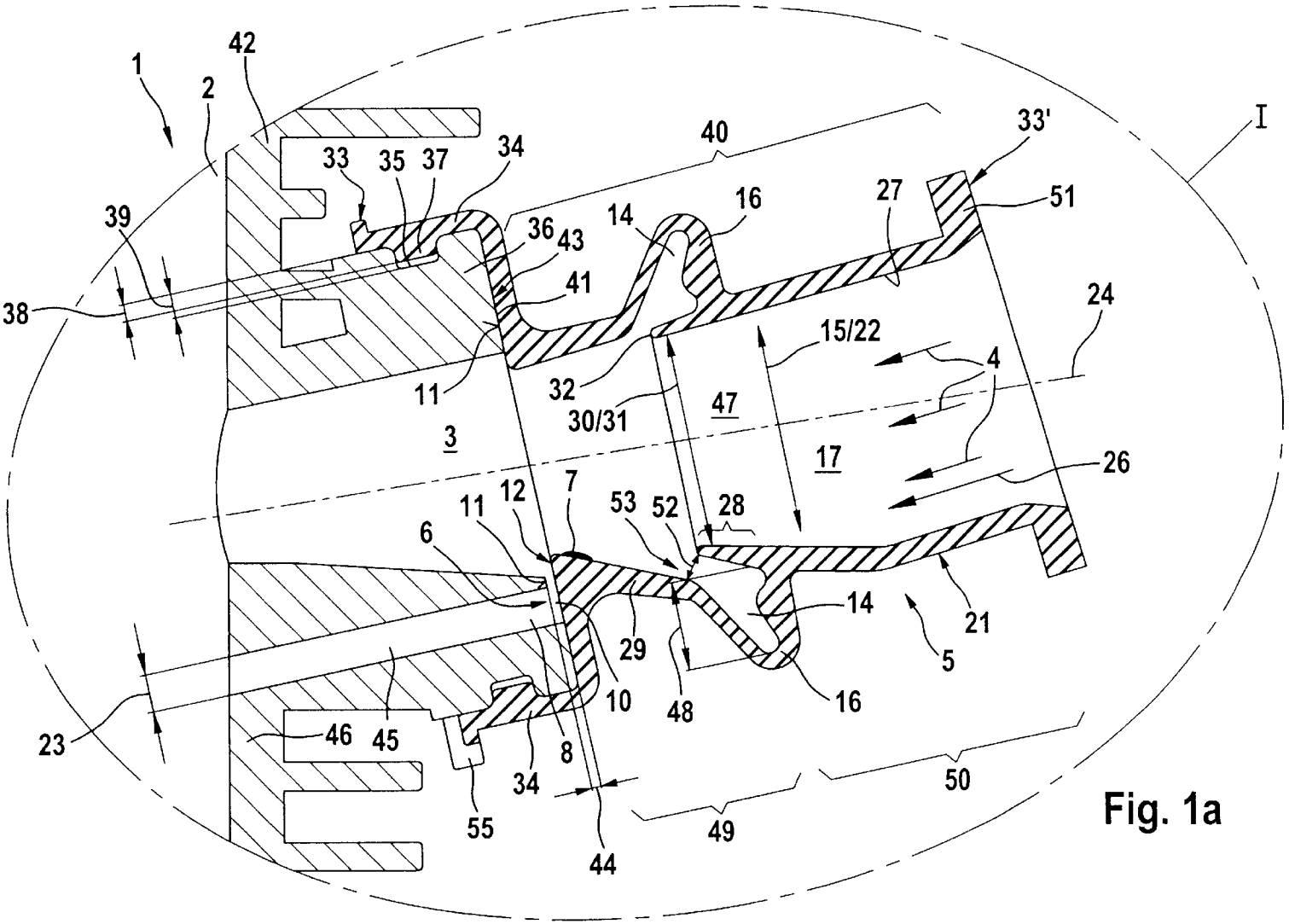
FIG. 1*a* is a detail view of the region I of FIG. 1 likewise shown in section.

The intake stub 5 is shown as detail I in FIG. 1*a* in longitudinal section and has respective flanges at its axial ends (33, 33'). The flanges are formed as respective radial expansions. The axial end 33 faces toward the inlet opening 3 on the cylinder 2 and is configured as a radially expanded connecting flange 34 for the cylinder 2. The connecting flange 34 is angled axially to the intake stub 5. To assemble the intake stub 5 on the cylinder 2, the connecting flange 34 of the end 33 is pushed over an annularly-shaped flange 36 on the cylinder 2. The flange 36 has a slot 35 and is formed as one piece on the cylinder 2 and surrounds the inlet opening 3. As shown in FIGS. 1, 1*a*, 2 and 4, the connecting flange 34 has an annular shoulder 37. The annular shoulder 37 has an elevation 38 which corresponds approximately to the depth 39 of the slot 35 and engages in the slot 35.

Figure 3:
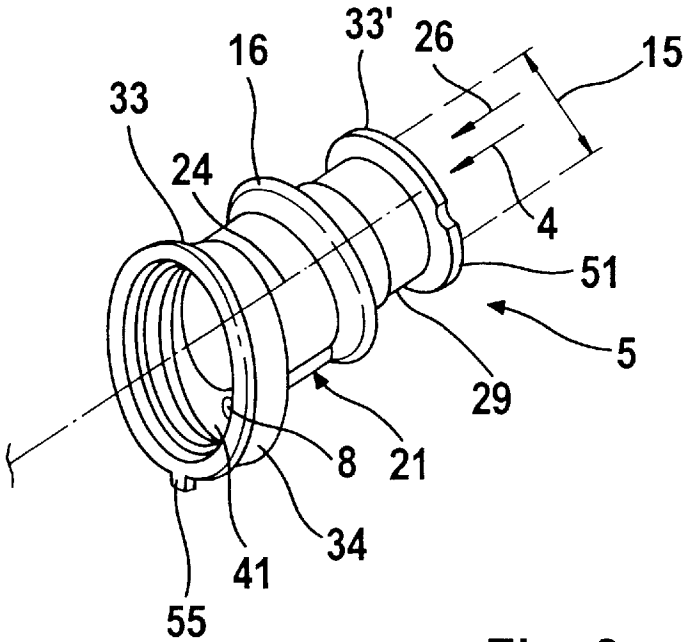
FIG. 3 is a perspective view of an intake stub.
Figure 4:
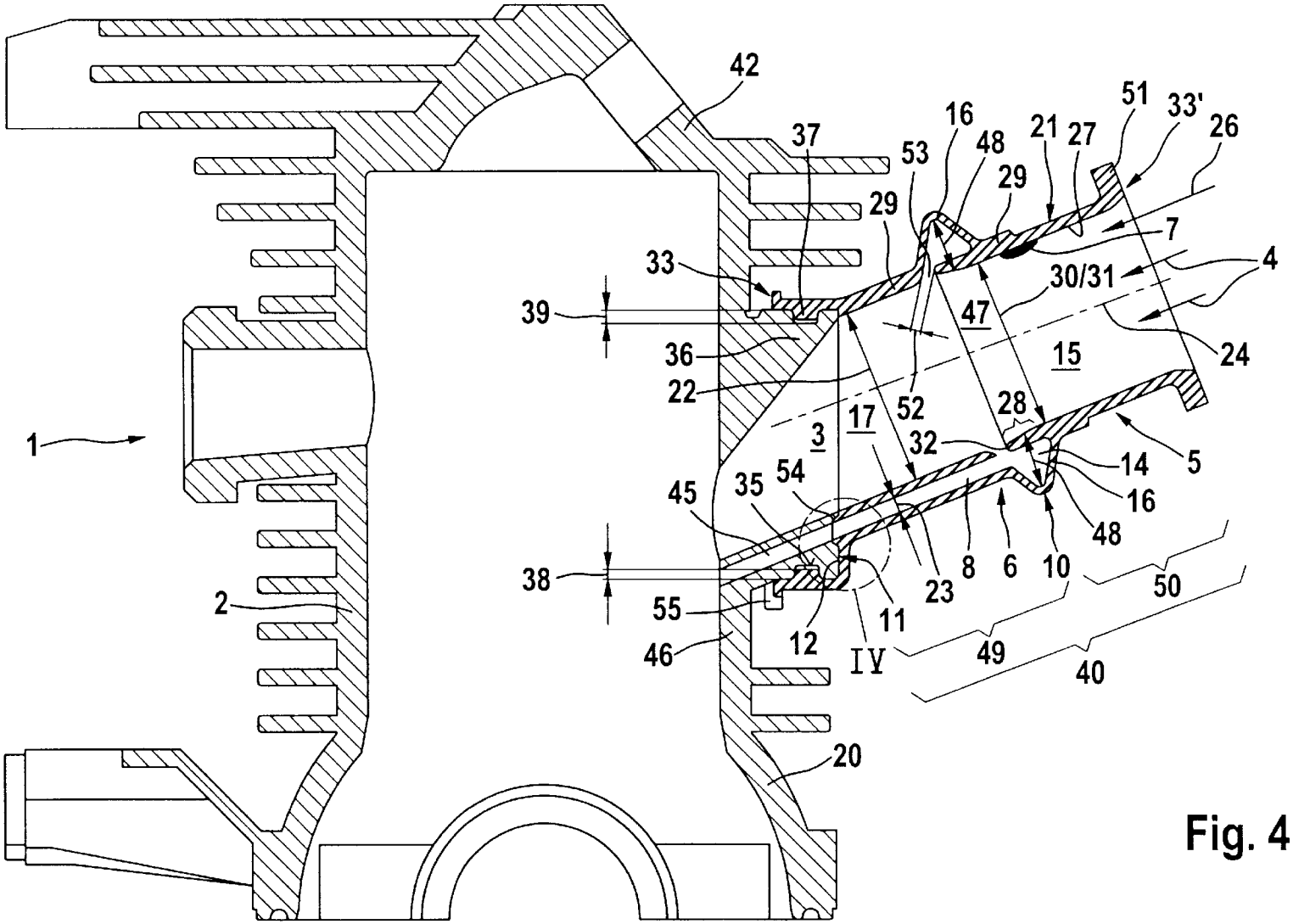
FIG. 4 is a longitudinal section view taken through the cylinder and the intake stub shown in FIGS. 3 and 3*a;*

In the intake stub 5 shown in FIGS. 3 and 4, the push-on flange 34 is arranged eccentrically to the longitudinal center axis 24 of the intake stub 5. The connecting flange 34 is mounted radially in the direction toward a crankcase 20 of the engine offset on the intake stub 5. An axial surface 41 is formed at the transition of the connecting flange 34 into the cylindrically-shaped part 40 of the intake stub 5. In the assembled state, the surface 41 comes into sealing contact engagement with the side 43 of the flange 36. The side 43 lies adjacent a cylinder head 42.

In the embodiment shown in FIGS. 1 and 1*a*, an axial spacing 44 is constructively provided between a cylinder outer surface 11 on the flange 36 and a surface 12 on the intake stub 5. In this way, a space is formed at the intake stub 5 between the cylinder outer surface 11 and the outer surface 12. This space has a pocket-shaped configuration and has the shape of a gap when viewed in cross section. The pocket-shaped space functions as a fuel collecting device 6 for fuel 7 which is precipitated on the inner side 27 of the intake stub 5. As shown in FIGS. 1, 1*a*, 2 and 3, a channel section 45 of a channel 8 is arranged in the cylinder 2 below the conically tapered inlet opening 3. The channel section 45 is narrower compared to the inlet opening 3. The channel 8 passes through the wall 46 and connects the interior of the cylinder or the crankcase 20 to the fuel collecting device 6. It can be practical to configure the fuel collecting device 6 as an annular space about the entire periphery of the flange 36 open toward the interior 17 of the intake stub 5 in lieu of a pocket-shaped space. The cylinder outer surface 11 and the surface 12 on the intake stub 5 are arranged at a spacing 44 to each other in the entire peripheral region of the intake stub 5. With this constructive measure, fuel can flow into the annular space via the entire inner periphery of the intake stub.

In the embodiments shown, the channel inner diameter 23 of the channel section 45 and of the channel 8 is approximately ⅕ to 1/10 of the size of the mean inner diameter 22 of the intake stub. During operation of the engine 1, an underpressure, which is essentially pulsating, is present in the channel 8 as well as at the inlet opening 3. The inlet opening 3 and the channel 8 are opened and closed cyclically by a piston, especially the piston skirt, which reciprocates in the cylinder 2. Because of the comparatively small clear cross section of the channel 8, there results a high flow velocity of the gaseous and liquid components in the channel 8. Fuel 7 disposed in the collecting space 10 or in the annular space is continuously and reliably conveyed away because of the high flow velocity of the gaseous and liquid components. In the interior of the cylinder 2, the fuel 7 reaches the air/fuel mixture, which flows in through the inlet opening 3, and is combusted therewith. A uniform operation of the engine is thereby effected independently of the particular spatial position of the engine and independently of the particular operating point of the engine. The collecting enclosure 10, which is shown in FIGS. 1 and 1*a*, is for the precipitated fuel 7 and can be practically arranged also in axial direction of the intake stub 5 viewed at a spacing to the cylinder outer surface 11. Here, the collecting enclosure 10 is practically configured in the wall 29 of the intake stub 5 and the channel 8 runs on the outer side 21 of the intake stub 5 approximately parallel to the longitudinal center axis 24 of the intake stub 5. It can be practical to configure the channel 8 in the wall 29 of the intake stub 5 and to form the same as one piece with the intake stub.

Figure 2:
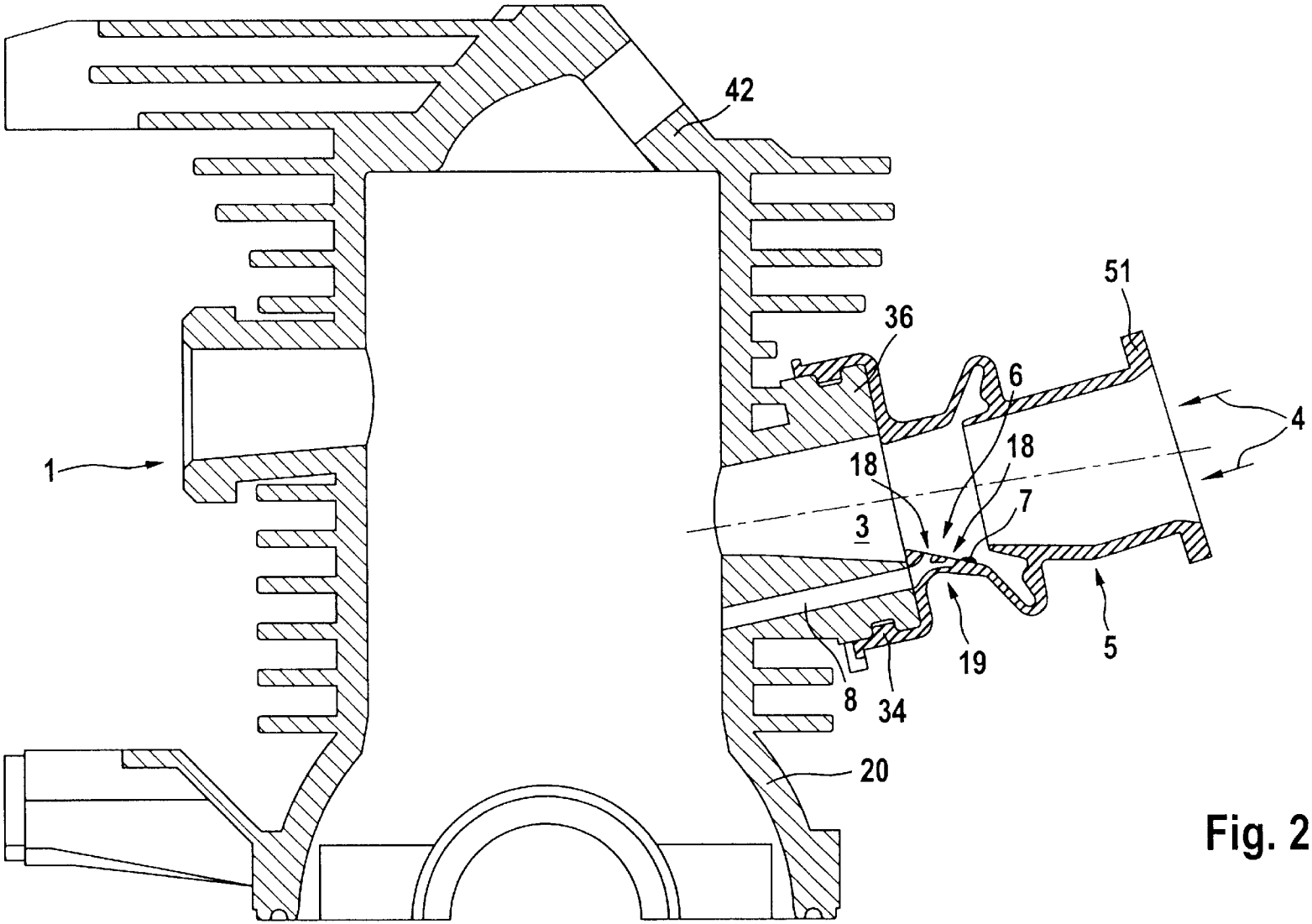
FIG. 2 is a longitudinal section view taken through a further cylinder of an internal combustion engine.

As FIG. 2 shows, the fuel collecting device 6 for precipitated fuel can be formed from openings 18 which open into the interior 17 of the intake stub 5. In the embodiment shown, multiple openings 18 of small diameter (preferably sieve-like) are arranged spaced one next to the other at a location 19 in the wall 29 of the intake stub 5. The openings 18 are fluidly connected to the channel 8 so that an underpressure is present at the openings 18 during the operation of the engine 1 and fuel is directed through the openings 18 and the channel 8 into the interior of the cylinder 2. The openings 18 can be arranged at desired points individually or can be arranged as several openings in axial direction one behind the other or in the peripheral direction in the intake stub 5. In this way, the openings 18 can be arranged on the inner side 27 of the intake stub 5 where fuel 7 preferably precipitates.

Figure 3A:
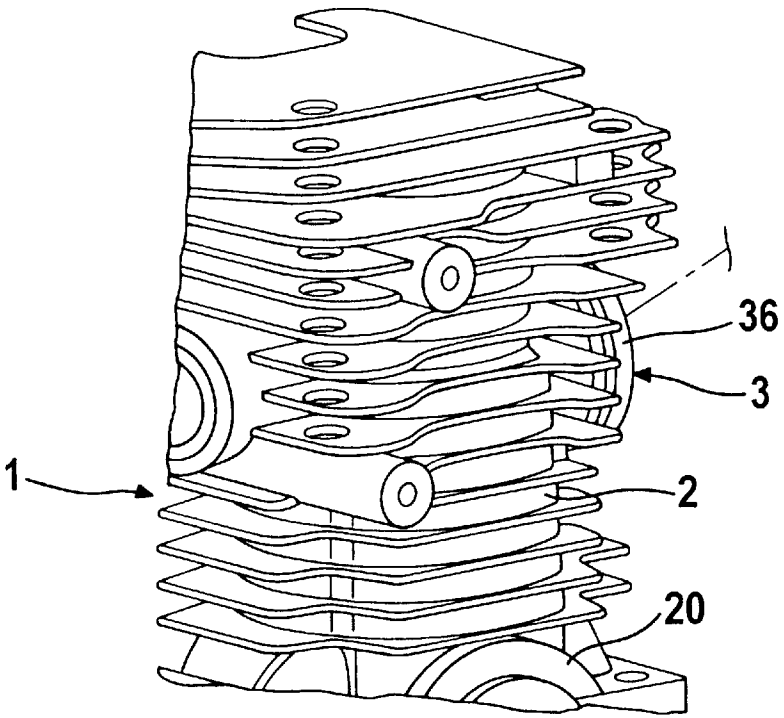
FIG. 3*a* is a perspective view of a cylinder of an internal combustion engine for accommodating the intake stub shown in FIG. 3.

In the embodiments of FIGS. 3, 3*a* and 4, the intake stub 5 has a thickening 16 at approximately its axial center 47. The thickening 16 protrudes radially out of the wall 29 and has a V-shaped cross section. The thickening 16 expands the clear cross section 15 of the intake stub 5 by an amount indicated by reference numeral 48. The axial section 49 of the intake stub 5 between the connecting flange 34 and the thickening 16 has a clear width 25 or inner diameter 22 which is approximately the same size as the axial section 50 of the intake stub 5 between the thickening 16 and the axial end 33 of the intake stub. The thickening 16 functions primarily for supporting the decoupling of the longitudinal and transverse vibrations between a carburetor and the cylinder 2. The carburetor is fixed at the axial end 33' and especially at an annular flange 51 provided there at the intake stub.

FIG. 4 shows the arrangement for an expanded thickening 16. Here, the axial section 50, which is disposed between the thickening 16 and the annular flange 51, extends on the inner side 27 of the intake stub 5 in the form of an annular-shaped section 28 of the wall 29 of the intake stub axially over the center of the thickening. In the unexpanded state of the thickening, the annular-shaped section 28 extends completely across the thickening 16 so that the forward end (that is, the annular-shaped edge 32 of the section 28) comes into contact engagement at the wall 29 of the intake stub and thereby forms a sealing lip. A distance 52 results between the annular-shaped edge 32 and the intake channel section 49. The thickening 16 and the ring-shaped section 28 thereby form an annular enclosed space or thickening interior space 14 which is opened to the interior of the intake stub 5 via an annular gap 53 between the annular-shaped edge 32 and the wall 29 of the axial section 49. The annular gap 53 is closed in the unexpanded state of the intake stub 5. The annular gap 53 opens and closes stochastically during operation of the internal combustion engine. Preferably, cutouts are also provided at the annular-shaped edge 32.

During operation of the engine 1, the air/fuel mixture 4 flows in the flow direction 26 from the carburetor to the inlet opening 3 at the cylinder 2 so that it is possible for the fuel 7, which is precipitated on the inner side 27 of the intake stub 5, to reach the thickening interior enclosure 14 via the annular gap 53 or the cutouts. The thickening interior enclosure 14 thereby functions as a fuel collecting device 6 for the fuel. This movement of the fuel 7 is supported by a radial circular flow or back flow at the annular-shaped edge 32. This circular flow is away from the longitudinal center axis 24 of the intake stub 5 and adjusts during operation of the engine. In the intake stub 5, the channel 8 is extended with the same inner diameter as the channel section 45 of the channel 8 in the cylinder 2. The channel 8 extends from the cylinder outer surface 11 at the flange 36 to the thickening interior enclosure 14 of the thickening 16 and fluidly connects the cylinder 2 (preferably the crankcase 20 thereof) to the interior enclosure 14 of the thickening. The channel 8 is formed as one piece with the intake stub 5 and extends along the outer side 21 thereof. It can be practical to subdivide the channel 8 into several branch channels over the length thereof and to permit the branch channels to open at different locations into the interior enclosed space 14. It can also be practical to provide several channels 8 about the periphery of the intake stub 5 and these channels 8 preferably open at the inlet opening 3.

Figure 4A:
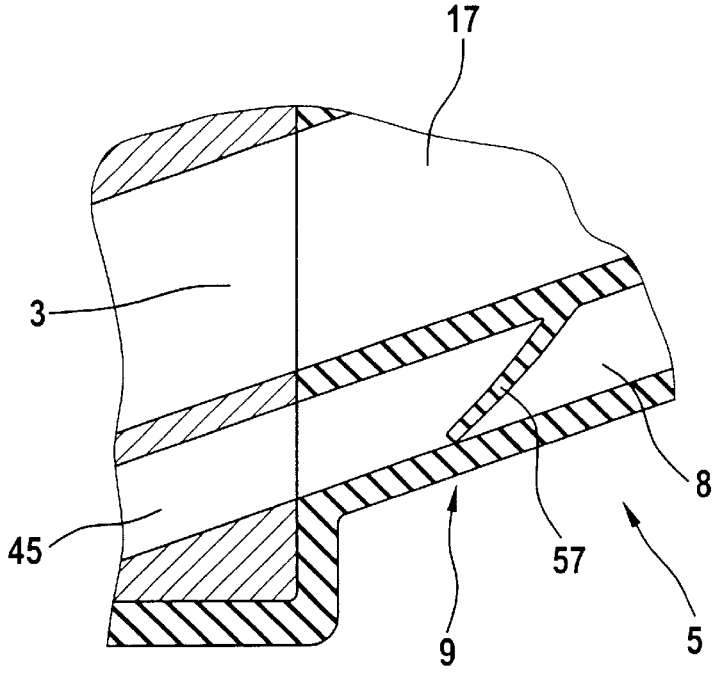
FIG. 4*a* is a detail view of the region IV of FIG. 4 wherein a simple flap valve is provided in the channel; and, FIG. 4*b* is a detail view of region IV wherein a duck-bill valve is shown formed in the channel.
Figure 4B:
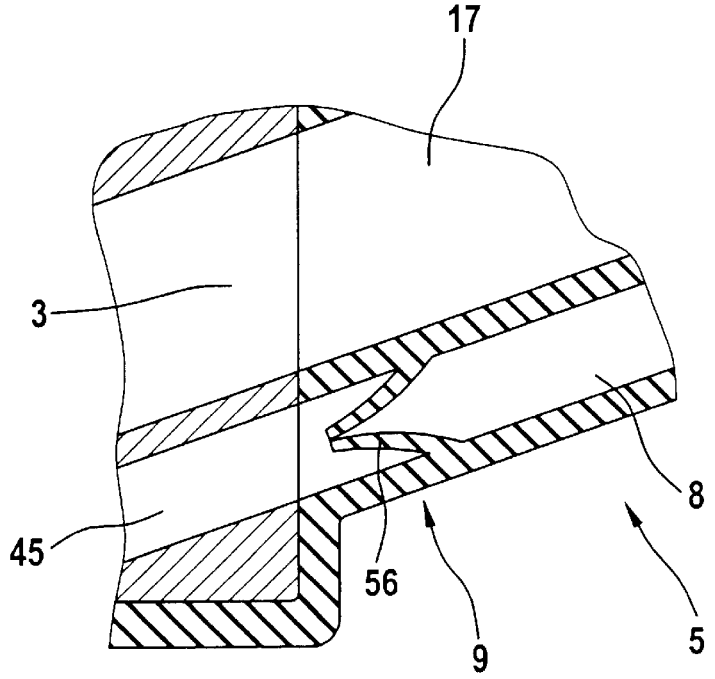

In FIGS. 4*a* and 4*b*, enlarged views of the detail IV of FIG. 4 are shown. A check valve 9 is provided in the channel 8 in both variations and opens in the direction toward the channel section 45. The check valve 9 opens when there is underpressure in the cylinder and thereby clears the channel 8. If there is no pressure drop present in this direction, the check valve 9 is closed whereby a pressing back of the fuel in the channel 8 is avoided.

In FIG. 4*a*, the check valve is configured as a simple flap 57 in the form of a lip formed of rubber material; whereas, in FIG. 4*b*, the check valve 9 is formed as a duck-bill valve 56 which can be configured as one piece with the intake stub 5 or can be seated in the channel 8.

The channel 8 opens at the surface 12 of the intake stub 5 with a protuberance 54 which tapers conically in the axial direction of the intake stub. The protuberance 54 of the channel 8 functions with a latch lug 55 which provides precise position allocation of the intake stub 5 relative to the cylinder 2 and prevents a rotation of the intake stub 5. The latch lug 55 is formed on the outermost radial edge of the connecting flange 34 as one piece with the intake stub 5. For this purpose, the protuberance 54 and the latch lug 55 engage in recesses in the cylinder 2 which are formed so as to be complementary.

It is understood that the foregoing description is that of the preferred embodiments of the invention and that various changes and modifications may be made thereto without departing from the spirit and scope of the invention as defined in the appended claims.

What is claimed is:

1. An internal combustion engine including a two-stroke engine for a portable handheld work apparatus including a motor-driven chain saw and cutoff machine, the engine comprising:

a cylinder having an inlet opening for receiving an air/fuel mixture;

an intake stub through which the air/fuel mixture passes and wherein fuel can precipitate out of said air/fuel mixture during operation of said engine;

said intake stub being made of elastic material and being mounted to conduct the air/fuel mixture into said inlet opening;

a fuel collecting device for collecting the fuel precipitated in said intake stub;

said fuel collecting device being delimited at least partially by said intake stub;

a channel connecting said fuel collecting device to said cylinder; and, said channel opening at said inlet opening.

2. The internal combustion engine of claim 1, wherein said fuel collecting device is a collecting space.

3. The internal combustion engine of claim 2, wherein said collecting space is delimited by an outer surface of said cylinder and a surface of said intake stub.

4. The internal combustion engine of claim 2, wherein said intake stub includes a thickening formed thereon to form an interior space defining said collecting space; and, said thickening annularly expanding the clear cross section of said intake stub.

5. The internal combustion engine of claim 4, wherein said thickening is configured in said intake stub at approximately the axial center thereof.

6. The internal combustion engine of claim 4, wherein the clear width of said intake stub is greater upstream of said thickening viewed with respect to the flow of said air/fuel mixture than downstream of said thickening.

7. The internal combustion engine of claim 4, wherein said intake stub defines a longitudinal axis and includes an annular wall defining the interior of said intake stub; and, said thickening is an annular thickening defining an annular cavity; and, said intake stub having an annularly-shaped section extending from said wall in said interior so as to at least partially extend over said cavity in the direction of said longitudinal axis.

8. The internal combustion engine of claim 7, wherein the clear width in said interior at said annularly-shaped section is approximately equal to the interior diameter of said intake stub upstream of said thickening viewed in the direction of the flow of said air/fuel mixture.

9. The internal combustion engine of claim 8, wherein said annularly-shaped section has an annular edge facing toward said inlet opening; and, said annular edge has a plurality of cutouts formed therein.

10. The internal combustion engine of claim 1, wherein said fuel collecting device is defined by a plurality of openings opening in the interior of said intake stub; and, said openings are fluidly connected to said channel.

11. The internal combustion engine of claim 1, wherein said channel has a channel inner diameter which is less than the inner diameter of said intake stub by a multiple.

12. An internal combustion engine including a two-stroke engine for a portable handheld work apparatus including a motor-driven chain saw and cutoff machine, the engine comprising:

a cylinder having an inlet opening for receiving an air/fuel mixture;

an intake stub through which the air/fuel mixture passes and wherein fuel can precipitate out of said air/fuel mixture during operation of said engine;

said intake stub being made of elastic material and being mounted to conduct the air/fuel mixture into said inlet opening;

a fuel collecting device for collecting the fuel precipitated in said intake stub;

said fuel collecting device being delimited at least partially by said intake stub;

a channel connecting said fuel collecting device to said cylinder;

said engine including a crankcase connected to said cylinder; and, said channel being formed essentially in said cylinder and opening into said crankcase below said inlet opening.

13. An internal combustion engine including a two-stroke engine for a portable handheld work apparatus including a motor-driven chain saw and cutoff machine, the engine comprising:

a cylinder having an inlet opening for receiving an air/fuel mixture;

an intake stub through which the air/fuel mixture passes and wherein fuel can precipitate out of said air/fuel mixture during operation of said engine;

said intake stub being made of elastic material and being mounted to conduct the air/fuel mixture into said inlet opening;

a fuel collecting device for collecting the fuel precipitated in said intake stub;

said fuel collecting device being delimited at least partially by said intake stub;

a channel connecting said fuel collecting device to said cylinder; and, said channel running along an outer side of said intake stub.

14. An internal combustion engine including a two-stroke engine for a portable handheld work apparatus including a motor-driven chain saw and cutoff machine, the engine comprising:

a cylinder having an inlet opening for receiving an air/fuel mixture;

an intake stub through which the air/fuel mixture passes and wherein fuel can precipitate out of said air/fuel mixture during operation of said engine;

said intake stub being made of elastic material and being mounted to conduct the air/fuel mixture into said inlet opening;

a fuel collecting device for collecting the fuel precipitated in said intake stub;

said fuel collecting device being delimited at least partially by said intake stub;

a channel connecting said fuel collecting device to said cylinder; and, said channel being formed as one piece with said intake stub.

15. An internal combustion engine including a two-stroke engine for a portable handheld work apparatus including a motor-driven chain saw and cutoff machine, the engine comprising:

a cylinder having an inlet opening for receiving an air/fuel mixture;

an intake stub through which the air/fuel mixture passes and wherein fuel can precipitate out of said air/fuel mixture during operation of said engine;

said intake stub being made of elastic material and being mounted to conduct the air/fuel mixture into said inlet opening;

a fuel collecting device for collecting the fuel precipitated in said intake stub;

said fuel collecting device being delimited at least partially by said intake stub;

a channel connecting said fuel collecting device to said cylinder;

said intake stub defining a longitudinal axis; and, said channel running approximately parallel to said longitudinal axis.

16. An internal combustion engine including a two-stroke engine for a portable handheld work apparatus including a motor-driven chain saw and cutoff machine, the engine comprising:

a cylinder having an inlet opening for receiving an air/fuel mixture;

an intake stub through which the air/fuel mixture passes and wherein fuel can precipitate out of said air/fuel mixture during operation of said engine;

said intake stub being made of elastic material and being mounted to conduct the air/fuel mixture into said inlet opening;

a fuel collecting device for collecting the fuel precipitated in said intake stub;

said fuel collecting device being delimited at least partially by said intake stub;

a channel connecting said fuel collecting device to said cylinder; and, a check valve being formed in said channel.

* * * * *